US005211482A

United States Patent [19]

Tilman

[11] Patent Number: 5,211,482

[45] Date of Patent: May 18, 1993

[54] CLOSURE FOR POST FILLING APPLICATION TO PACKAGING

[75] Inventor: Paul A. Tilman, New City, N.Y.

[73] Assignee: Minigrip, Inc., Orangeburg, N.Y.

[21] Appl. No.: 747,787

[22] Filed: Aug. 19, 1991

[51] Int. Cl.[5] ..... B65D 33/16

[52] U.S. Cl. ..... 383/202; 24/587; 383/61; 383/64; 383/81; 383/203; 493/213; 493/214

[58] Field of Search ..... 383/61, 63, 64, 65, 383/81, 202, 203; 24/587; 493/213, 214, 215

[56] References Cited

U.S. PATENT DOCUMENTS

| | | | |
|---|---|---|---|
| 2,994,469 | 8/1961 | Troup et al. | 383/61 |
| 3,122,807 | 3/1964 | Ausnit | 383/64 |
| 3,181,583 | 5/1965 | Lingenfelter | 383/61 |
| 4,268,938 | 5/1981 | Walchli | 383/63 |
| 4,713,839 | 12/1987 | Peppiatt | 383/61 |
| 4,807,300 | 2/1989 | Ausnit et al. | 383/65 |
| 4,874,257 | 10/1989 | Inagaki | 383/63 |
| 4,892,512 | 1/1990 | Branson | 24/587 |
| 5,033,868 | 7/1991 | Peppiatt | 383/61 |
| 5,047,002 | 9/1991 | Zieke et al. | 493/214 |

*Primary Examiner*—Stephen P. Garbe

*Attorney, Agent, or Firm*—Kane, Dalsimer, Sullivan, Kurucz, Levy, Eisele and Richard

[57] ABSTRACT

A zipper closure strip for attachment to the top of a formed, filled and sealed package is provided. The zipper strip has a pair of interlocking profile members that extend from bowed webs which conform generally to the cross section of the top of the filled package. The strip may thus straddle the top of the package, gable fashion, and be bonded to the top of the package by heat seals, adhesive or the like. A slider seats on the profile members for urging them into engagement or forcing them apart. A blade protrudes through the slider from a plunger to enable the film at the top of the package beneath the closure strip to be slit. The zipper may be cuffed to expose the top end of the package to facilitate opening.

3 Claims, 3 Drawing Sheets

CLOSURE FOR POST FILLING APPLICATION TO PACKAGING

BACKGROUND OF THE INVENTION

The present invention relates to closures and in particular to a zipper closure for post applied application to a filled package.

Reclosable plastic bags, that is, bags provided with a pair of mating profiles that form a zipper to render the bags readily reclosable after initial opening are becoming increasingly popular as primary packaging for a range of products, particularly food products. Such packaging and the methods of making the same are described, for example, in U.S. Pat. No. 4,709,533 and the patents discussed therein.

It will be appreciated that the primary concern in the manufacture of food packaging is to ensure that the package maintains the necessary barrier properties and integrity to protect the food contained therein. With certain foods, such as potato chips or popcorn, the packaging must further be "pillowed" to provide a degree of shock protection for the contents. Accordingly, when it is desired to package such foods in zippered packaging, care has to be taken to ensure that the film from which the package is formed possesses the necessary properties to protect the food to be packaged therein and that application of the zipper to the film does not interfere with the integrity of the final package or alter the nature of the final package. It should be understood that the zipper provides only a secondary closure for the package that enables the contents of the package to be effectively retained and removed after the primary seal of the package has been ruptured.

High volume food and other similar products are usually packaged on form, fill and seal equipment in which the package is formed and filled, often in-line with the food production equipment. After filling the package must be hermetically or otherwise sealed to protect the contents. When such products are to be packaged in zippered packaging, the zipper is either preapplied to the film from which the package is formed or applied to the film at the form fill and seal equipment. This has previously required a modification of such form, fill and seal equipment to accommodate the zipper and/or resulted in a slow down in the filling speed of the equipment, which in turn has caused reluctance on the part of some manufacturers to change from conventional packaging to zippered packaging.

SUMMARY OF THE INVENTION

In view of the above it is a principal object of the present invention to provide an improved zippered closure that can be post applied to a conventional package after filling and sealing without interfering with the filling operation.

A further object is to provide such a closure that may be post applied to a filled package without requiring any change in the construction of the filled package or the material from which it is formed.

A still further object is to provide means on the closure for readily rupturing the seal of a filled package to which the closure has been applied.

Yet another object is to provide a closure which may be applied with equipment that is not dedicated to any particular equipment and may be utilized across a wide range of form fill and seal equipment.

The above and other beneficial objects and advantages are attained in accordance with the present invention by providing a zipper strip for attachment to the top of a formed, filled and sealed package. The zipper strip is generally inverted U-shaped in cross section and comprises a pair of interlocking profile members. Each of the interlocking members extends generally parallel to the axis of the inverted U-shaped cross-section from an arcuate or bowed web. The webs and profile member define a gable that conforms generally to the cross section of the top of the filled package. The strip may thus straddle the top of the package and be bonded to the top of the package by heat seals, adhesive or the like.

To open the package the profiles must be separated and the top of the package ruptured to break through the primary seal of the package afforded by the sealed barrier film. To this end the zipper strip may be provided with a slider and a scoring protrusion or blade for rupturing the package. During the initial opening of the zipper the protrusion is used to cut through the film behind the zipper thereby providing access to the contents of the package. Thereafter the package may be reclosed by reinterlocking the zipper members.

DETAILED DESCRIPTION OF THE PREFERRED EMBODIMENT

Figure 1:
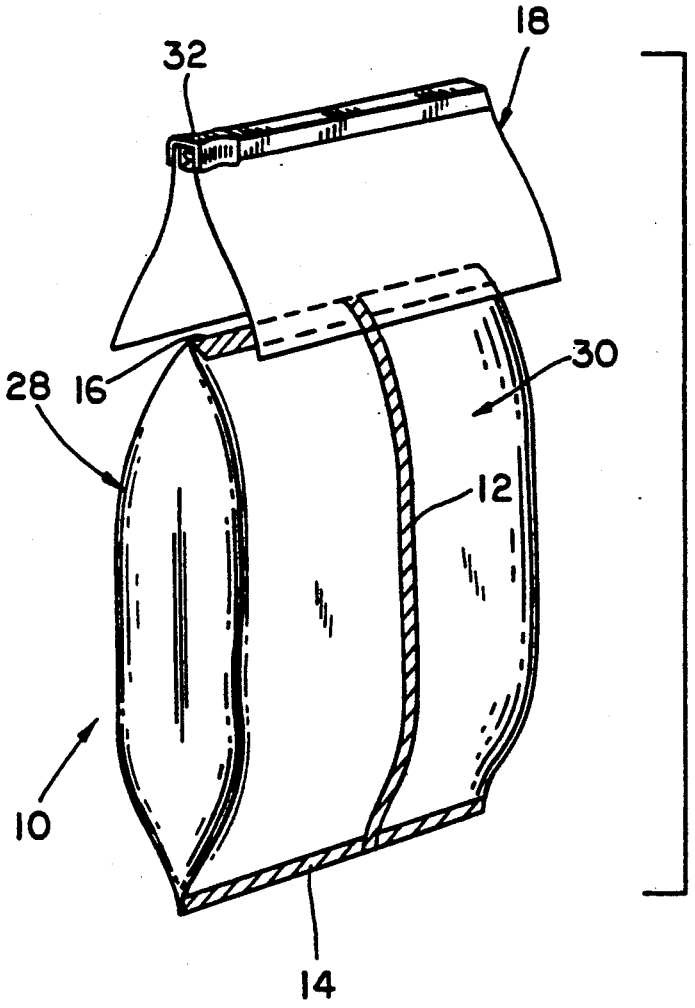
FIG. 1 is an exploded perspective view of a package formed of a plastic film and an associated zipper closure in accordance with the present invention.

Reference is now made to the drawings and to FIG. 1 in particular wherein a plastic package 10 which is made and filled on form, fill and seal equipment is depicted. As mentioned, such packages are very commonly used to package a wide variety of goods including such food products as potato chips, pop corn and the like. The package 10 is formed of an appropriate barrier film to protect the contents of the package and to a large extent is filled with air or a suitable inert gas so as to form a pillow package to provide cushioning and shock protection for the contents. The package 10 is formed with a longitudinal seam 12 and bottom and top seams 14 and 16. The seams are formed by bringing the edges of the film together and bonding them to one another so form an airtight seal.

Figure 2:
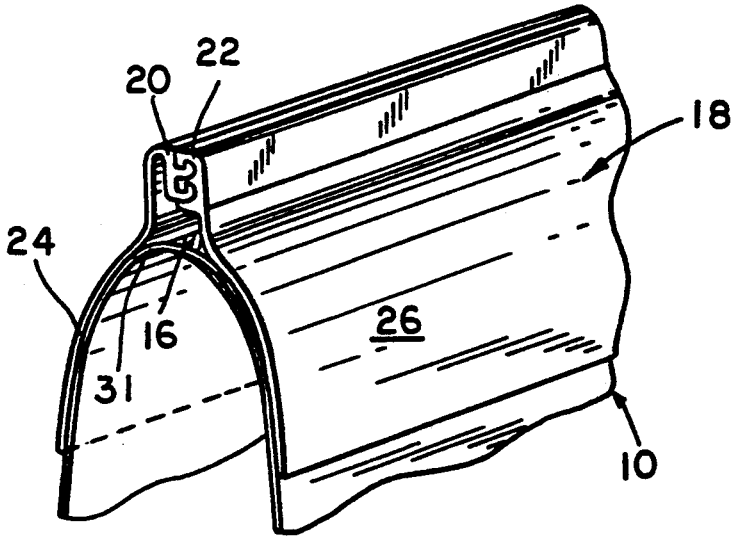
FIG. 2 is a fragmentary perspective view of a package provided with a closure of the present invention.
Figure 5:
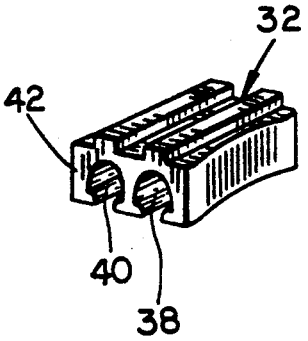
FIG. 5 is a perspective view of the opening end of the slider.

In accordance with the present invention, a zipper closure strip 18 is applied to the top of the package and bonded in place over the package top. That is the package below the zipper strip 18 is an integral package capable of completely protecting the contents of the package. It is an important feature of the present invention that the reclosure feature of the present invention when applied to the package does not violate or in any manner interfere with the integrity of the package or the manner in which the integrity is attained. That is, the closure plays no part in the barrier structure of the package which is conventionally attained. Referring to FIG. 2 it can be seen that the zipper strip 18 comprises a pair of interlocking profile members 20, 22 each of which is integral with a web member 24 and 26, respectively. The webs 24 and 26 each bow outwardly and downwardly from their respective interlocking profile member so that when the profiles are joined the zipper closure 18 is generally gable shaped and defines an inverted U-shaped cross section. This shape permits the zipper closure strip 18 to straddle the top of the sealed package 10 as shown in FIG. 2. To this end, the top seal 16 of the package 10 is turned downwardly. Since the zipper closure strip 18 is outside the barrier seal provided by the film from which the package 10 is formed and is not necessary to provide any barrier properties to the package, it may be formed of any suitable material which facilitates it manufacture, such as polyethylene, so long as the material is compatible with the contents of the package. To secure the zipper closure in position over the top of package 10 the webs 24,26 of the zipper closure 18 are bonded to the package sides 28,30 by means of heat seals, adhesives or the like. To gain access to the contents of the package the zipper closure is opened and the film 31 underlying the zipper closure must be slit. By reclosing the zipper the package may then be reclosed and opened as often as desired.

To facilitate the opening and closing of the zipper closure 18 when mounted on package 10, the zipper closure 18 is provided with a slider 32. The slider 32 seats about the profiles 20,22 in a conventional manner and serves to force the profiles into engagement when the slider is moved in the direction of a closing end 34, wherein both profiles must pass through a single channel 36, and to force the profiles apart and to pass through separate channels 38,40 when the slider 32 is moved in the direction of an opening end 42.

Figure 3:
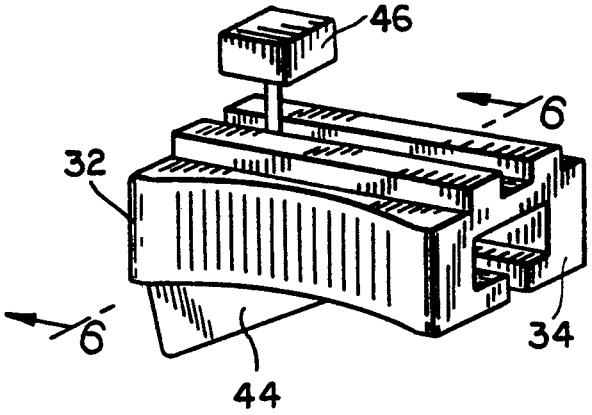
FIG. 3 is a perspective view of a slider for use on the zipper of the closure of the present invention.
Figure 4:
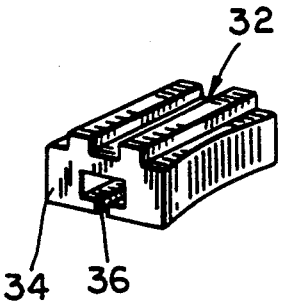
FIG. 4 is a perspective view of the closing end of the slider of FIG. 3.
Figure 6:
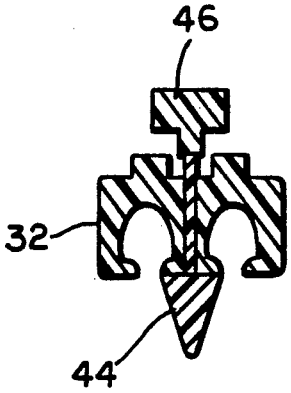
FIG. 6 is a sectional view taken along reference lines 6—6 of FIG. 3; and, FIG. 7 is a perspective view of an alternative zipper closure with the present invention.

Referring to FIG. 3 it may be seen that the slider 32 is further provided with a blade-like protrusion 44 which extends downwardly from a connecting plunger 46 extending through the slider body. The blade 44 extends upwardly toward the opening end of the slider 32. To open the package 10 for the first time the plunger 46 is depressed causing the blade 44 to pierce though the underlying film 31 of the package. The slider is then moved in the direction of the opening end 42 of the slider 32 causing the film to "run" as it is cut by the blade and simultaneously causing the interlocking profiles 20, 22 to disengage. As a result the package is opened and access may be had to the package contents. By moving the slider in the opposite direction the profiles are reinterlocked, thereby closing the package.

Figure 7:
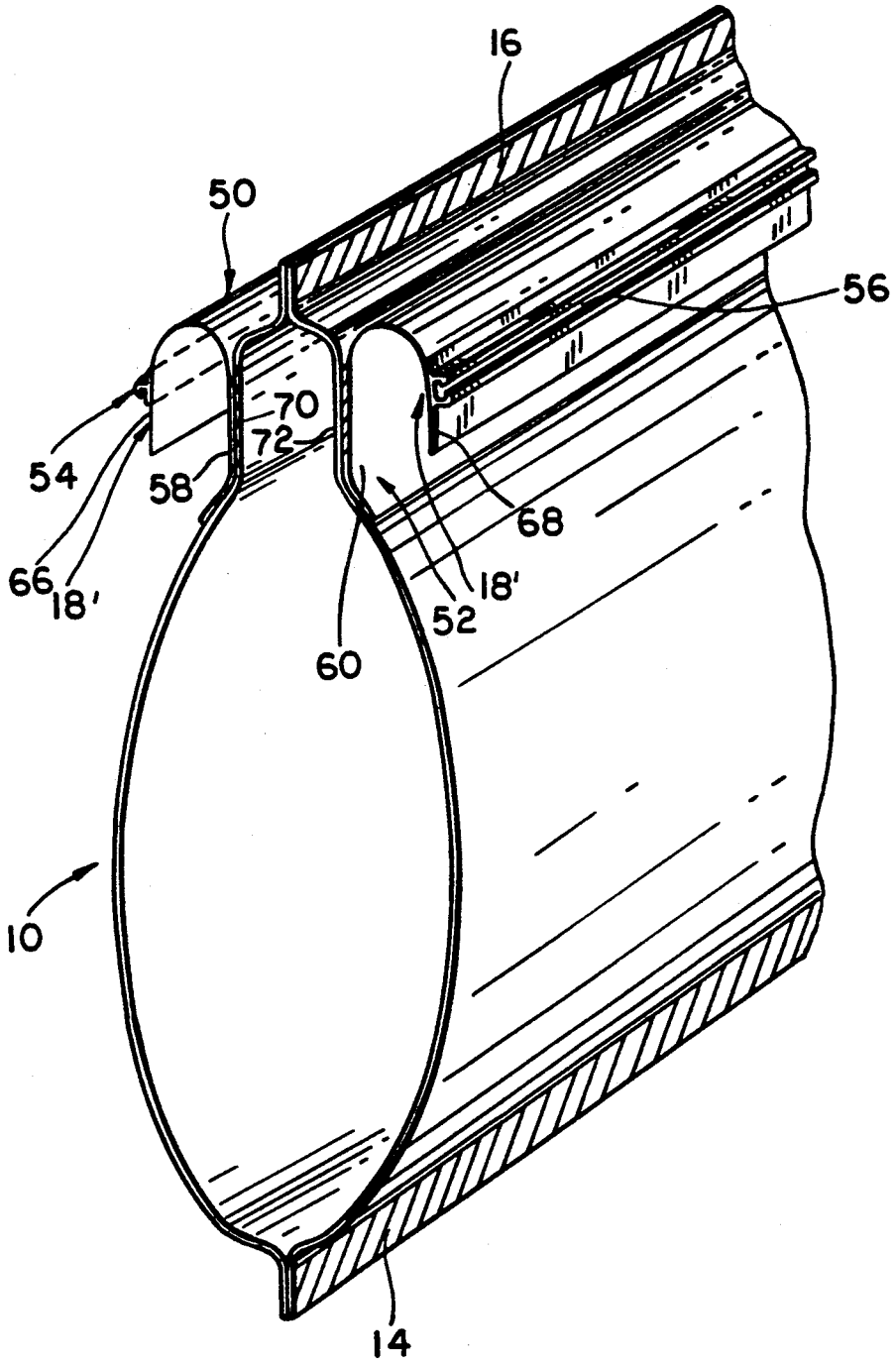

Reference is now made to FIG. 7 wherein an alternative zipper 18' is depicted applied to a package 10. As before the package 10 comprises a complete barrier for its contents and is formed on conventional form fill and seal equipment. The zipper 18' comprises zipper strips 50,52 containing respectively a male profile 54 and a female profile 56 which are configured to enable them to interengage without means of a slide. Such configurations are disclosed, for example, in U.S. Pat. No. 3,198,228. In accordance with this embodiment the zipper strips 50,52 include web members 58,60, respectively, which are secured to the outside of package 10 on opposite sides of package 10 adjacent the top edge 16 along sealing zones 70,72. The webs are folded back so as to form a cuff through which the top of the package 10 extends as shown. Thus, the package 10 may be opened by cutting the top edge. Thereafter the cuff formed by the folded back webs may be rolled upwardly to enable the profiles 54,56 to engage and thereby provide a reclosure for the package. To this end the distance from each profile 54,56 to its associated seal zone 70,72 is such that the profiles will engage above the top end of the package thereby enabling the zipper 18' to be closed even before opening the package 10.

It should be appreciated that while the side edges 62,64 and 66,68 of the zippers 18 and 18' have been shown separated in practice the edges are joined to one another so that once the zipper strips 18 or 18' are secured in place over a package 10 the zipper strip when closed fully recloses an opened package.

It should further be appreciated that the zipper closure 18 or 18' is applied to the package 10 only after the package is completely formed and filled. Therefore, no modification is required of either the package, the film from which the package is formed or the form, fill and seal equipment to apply the zipper closure to the package. Further, the zipper closure need not be applied to the package at the time of its filling but may be applied in a separate downstream operation and therefore will not interfere with the operating speed of the form fill and seal equipment.

Thus in accordance with the above the aforementioned objects are effectively attained.

Having thus described the invention, what is claimed is:

1. A zipper closure strip for post filling application to a sealed prefilled plastic package, said closure strip comprising:

first and second webs, each said web having an edge, first and second interlocking profile members, each of said profile members being formed on one of said webs adjacent to said respective edge, each of said webs bowing outwardly away from the other web and downwardly away from its respective profile member wherein said closure strip has a generally inverted U-shaped cross-sectional configuration to enable said closure strip to straddle a top end of said prefilled package with said webs abutting opposite sides of said prefilled package;

a slider disposed about said profile members and adapted to urge said profile members into engagement with each other when slid in a first direction and to force said profile members out of engagement with each other when slid in an opposite direction; and, a blade member extending downwardly from a bottom surface of said slider.

2. The zipper closure in accordance with claim 1 wherein said profile members extend generally parallel to a transverse axis of said U-shaped cross-section.

3. The invention in accordance with claim 1 wherein said blade is affixed to a plunger extending upwardly from said slider, said plunger being sufficiently long to urge said blade to penetrate a top end of said package when said closure is affixed to said package and said plunger is depressed.

* * * * *